United States Patent [19]

Thut et al.

[11] 4,244,423

[45] * Jan. 13, 1981

[54] HEAT EXCHANGER

[76] Inventors: Bruno H. Thut, 9580 Stafford Rd., Bainbridge, Ohio 44022; Dale T. Lehman, 5577 Valley La., Solon, Ohio 44139

[ * ] Notice: The portion of the term of this patent subsequent to Oct. 10, 1995, has been disclaimed.

[21] Appl. No.: 924,912

[22] Filed: Jul. 17, 1978

Related U.S. Application Data

[63] Continuation-in-part of Ser. No. 796,175, May 12, 1977, Pat. No. 4,119,141.

[51] Int. Cl.[3] ..... F28F 9/12

[52] U.S. Cl. ..... 165/82; 165/158; 285/356

[58] Field of Search ..... 165/81, 82, 158; 285/356 R, 415

[56] References Cited

U.S. PATENT DOCUMENTS

| | | | |
|---|---|---|---|
| 1,434,952 | 11/1922 | Johnson, Jr. | 285/356 X |
| 1,556,245 | 10/1925 | Banta | 285/415 X |
| 2,520,755 | 8/1950 | Brown, Jr. | 285/415 X |
| 3,294,159 | 12/1966 | Kovalik et al. | 165/81 |
| 3,327,777 | 6/1967 | Kovalik et al. | 165/81 |
| 3,797,564 | 3/1974 | Dickinson | 165/158 X |
| 3,833,055 | 9/1974 | Munz et al. | 165/158 |
| 4,119,141 | 10/1978 | Thut et al. | 165/158 |

*Primary Examiner*—Samuel Scott
*Assistant Examiner*—Theophil W. Streule, Jr.
*Attorney, Agent, or Firm*—Watts, Hoffman, Fisher & Heinke Co.

[57] ABSTRACT

A heat exchanger comprising an elongated tubular cylindrical member having fluid ingress and egress openings adjacent to its opposite ends and external flanges at opposite ends one of which flanges has a counterbore facing in the direction away from the cylindrical member. A plurality of graphite tubes within the cylindrical member having their opposite ends connected to graphite headers one of which is connected through a graphite end member to one end of the cylindrical member and the other of which has an outside diameter slightly less than the inside diameter of the cylindrical member and within which it is slidable or floats. The floating header has an external circumferential groove with outwardly inclined ends. A seal is provided at the end of the cylindrical member at which the floating header is located which seal includes packing in the counterbore in the adjacent flange and a gland member slidable on the floating header and adjustable towards the flange. A part of the gland member overlies one end of the external groove in the floating header member. A second graphite end member abuts the end of the floating header facing in the direction away from the cylindrical member and is clamped thereto by a clamp plate engaging the other side of the end member. A sleeve formed of a plurality of arcuately shaped parts is located in the circumferential groove in the floating header with an end underlying the gland member and has an external groove spaced from the gland member in which a split ring is located extending radially of the sleeve and having its radial outer or circumferential surface inclined radially outwardly in the direction away from the cylindrical member. A retainer ring surrounds the split ring and is connected to the clamp plate at the end of the second end member facing in the direction away from the cylindrical member by a plurality of bolts.

3 Claims, 2 Drawing Figures

HEAT EXCHANGER

RELATED APPLICATIONS

This application is a continuation-in-part of copending application Ser. No. 796,175, filed May 12, 1977, now U.S. Pat. No. 4,119,141 granted Oct. 10, 1978, entitled Heat Exchanger.

BACKGROUND OF THE INVENTION

1. Field of the Invention

The invention relates to shell and tube heat exchangers utilizing graphite tubes typically employed in the chemical industry.

2. Description of the Prior Art

Shell and tube type heat exchangers with removable graphite tube bundles are commerically available. Graphite, however, is relatively fragile and difficulty is experienced in adequately supporting the graphite bundles against failure, particularly the floating graphite header or headers to which the ends of the tubes are connected. Fluid connections are made to the tubes or more particularly to the sides of the graphite headers opposite to the sides to which the tubes are connected through graphite end or dome members clamped thereagainst. Various arrangements have been employed to clamp the graphite end or dome member to the floating graphite header but because of the fragile character of graphite the connection of the clamp structure to the floating header is difficult considering the pressures to which the parts are subjected during use. Prior connections are also difficult to dissassemble for purposes of replacing the tube bundle or performing maintenance work thereon and/or have a very short life.

SUMMARY OF THE INVENTION

The invention provides a novel and improved heat exchanger of the shell and tube type having a removable tube bundle made of graphite at least one end of which floats in the shell and to which end a fluid connection is made through a graphite end or dome member clamped to the floating graphite header by a clamp structure which is simple in construction, can be readily disassembled for maintenance or replacement of the tube bundle, and which will not damage the graphite members.

The invention also provides a novel and improved clamp structure for clamping a graphite end or dome member to a graphite floating header of a graphite tube bundle of a shell and tube type heat exchanger which includes a sectional sleeve having a smooth interior and at least the end adjacent to the dome member internally beveled positioned in a smooth external groove in the floating header having at least one end beveled complementary to the internally beveled end of the sleeve, a split ring surrounding the sleeve and having a frustoconical cross-section with the longer end or base facing in the direction of the end or dome member, a retainer ring surrounding the split ring, a clamp plate at the end of the end or dome member and means for drawing the retainer ring and the clamp plate towards one another.

Other advantages of the invention will be hereinafter referred to or will be apparent from the following description of the preferred embodiment.

DESCRIPTION OF THE PREFERRED EMBODIMENT

Figure 1:
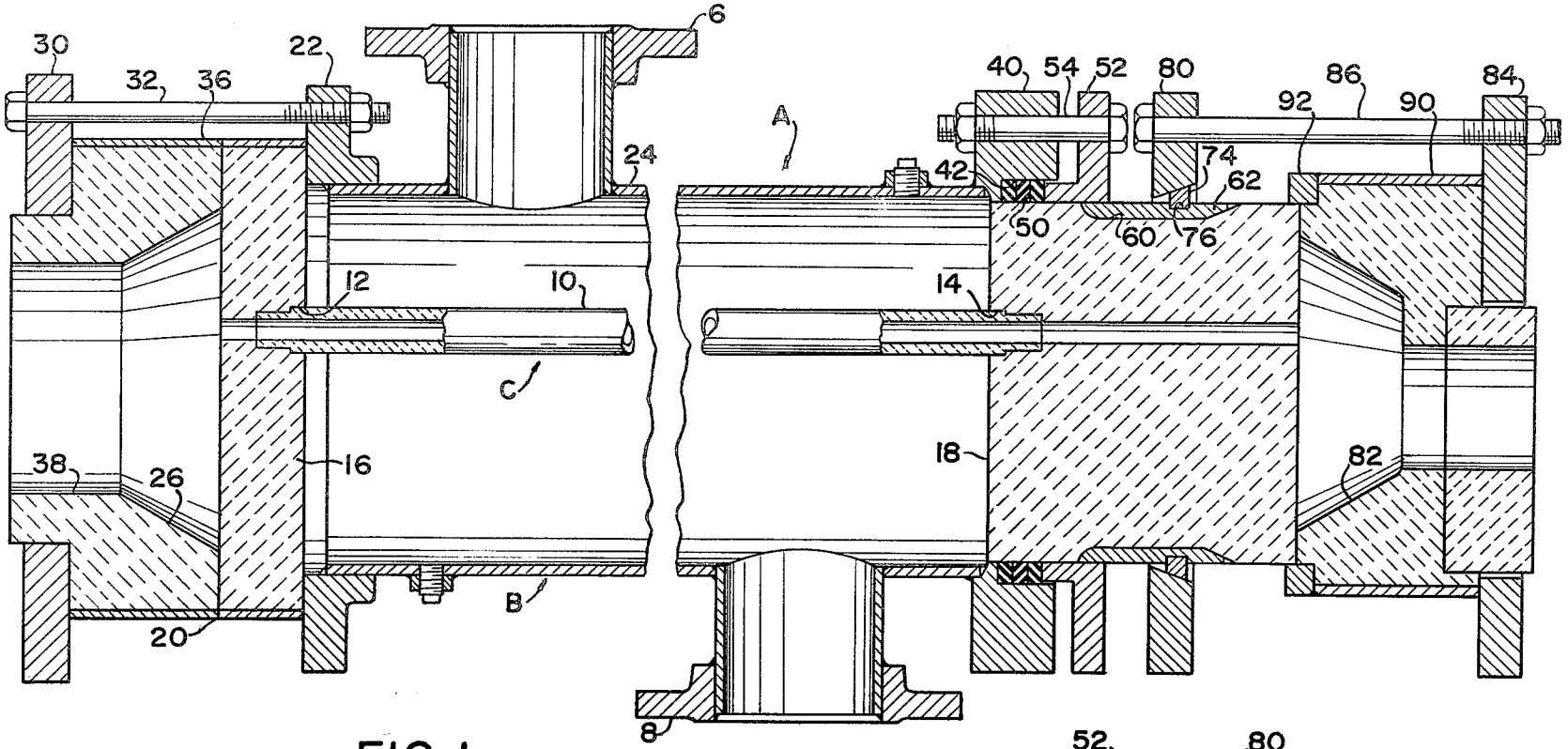
FIG. 1 is a fragmentary cross-section with parts in elevation of a heat exchanger embodying the invention.
Figure 2:
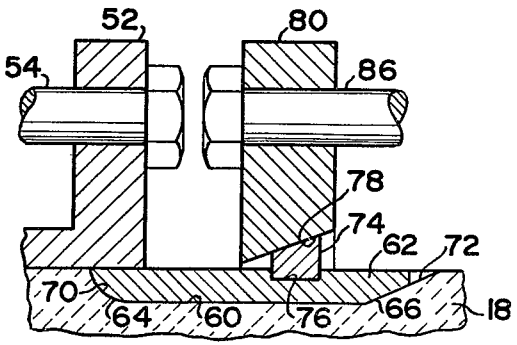
FIG. 2 is an enlarged view of a portion of FIG. 1.

The heat exchanger depicted in the drawings and designated generally by the reference character A is of the single pass construction and comprises a metal shell B enclosing a graphite tube "bundle" C the left-hand end of which is fixed relative to the shell and the other end of which is free to float in the shell. The shell B has transversely extending fluid ingress and egress openings or fittings 6, 8 adjacent to its opposite ends.

The tube "bundle" C includes a plurality of graphite tubes 10, only one of which is shown, having their opposite ends supported in suitable apertures 12,14 in stationary and floating graphite tube sheets or head members 16,18 respectively. The left-hand tube sheet 16 is surrounded by a reinforcing and protective metal tube sheet cover or skirt 20 and the peripheral part of the tube sheet 16 is clamped between a heavy shell flange member 22 welded to the left-hand end of the cylindrical member 24 of the shell B and a stationary graphite end member or dome 26 by a heavy metal clamp plate member 30 engaging the left-hand peripheral part of the dome member 26 and bolts 32 connecting the clamp plate 30 to the flange 22. The end member 26 is provided with an encircling protective metal skirt 36 and a reduced diameter part 38 of the member 26 projects to the left through the clamp plate 30. The right-hand end of the cylindrical member 24 of the shell B has a heavy shell flange member 40 welded thereto and which extends a short distance to the right of the member 24. The outer end of the member 40 is counterbored as at 42.

The right-hand floating head or tube sheet member 18 is relatively long compared with the left-hand sheet member, is of slightly less diameter than the internal diameter of the cylindrical shell member 24 and "floats" in the right-hand end of the shell B, thus providing for expansion and contraction of the tube "bundle" C without damage to the "bundle". The floating head member 18 projects beyond the right-hand end of the shell B and leakage therebetween and the shell is prevented by packing 50 located in the counterbore 42 in the flange 40 and adjustable therein by a gland member 52 slidably supported on the head member 18 and connected to the flange 40 by bolts 54.

The floating head member 18 has a relatively long, external, circumferential, smooth groove 60 therein within which a sleeve member 62 is located. The ends of the sleeve member 62 are provided with internal bevels 64,66 and the ends of the groove 60 are provided with complementary bevels 70,72. The member 62 is made up of a plurality of arcuate members held in assembled relation by a metal split ring 74 located in a circumferential groove 76 in the member 62 and from which groove it extends an appreciable distance. The split ring 74 is trapezoidal in cross-section with the exterior surface 78 thereof inclined upwardly or outwardly towards the right and is engaged by a complementary inclined surface on the interior of a metal retainer ring 80. The right-hand or outer end of the floating head member 18 is abutted by the peripheral part of the left-hand or inner end of a floating or right-hand graphite end member or dome 82 to which it is clamped by a metal clamp plate 84 at the left-hand end of the member 82. The clamp plate 84 is connected to the retainer ring 80 by bolts 86. The floating end member 72 is provided with a protective metal cover 90 which has a ring member or floating spacer 92 welded to its left-hand end. The right-hand end of the member 18 extends into the spacer 92. The outer ends of members 26, 82 are adapted to be connected to or supplied with suitable conduits for the ingress and egress of fluid to and from the tube bundle C.

In the depicted heat exchanger the length of the sleeve member 62 is equal to about one-third of the diameter of the member 18 and thus provides a large area contact with the member 18 allowing it to be securely clamped to the member 18 without injury thereto. Other advantages of the invention will be apparent to those skilled in the art to which the invention relates.

While the preferred embodiment of the invention is of the so called single pass construction and has been described in considerable detail the construction shown can be modified and the invention can be incorporated in a multiple pass heat exchanger etc. and it is the intention to hereby cover all such modifications and/or applications which come within the practice of those skilled in the art to which the invention relates and the scope of the appended claims.

What is claimed is:

1. A heat exchanger of the character described comprising an elongated shell having a tubular cylindrical member having flange members adjacent to its opposite ends, one of said flange members having a counterbore facing in the direction away from said cylindrical member, a plurality of tubes having their opposite ends connected to header members, means including an end member connecting one of said header members to the other of said flange members, the other of said header members having an outside diameter slightly less than the inside diameter of said end of said cylindrical member at which said one of said flange members is located and being slidable therein, said other of said header members having an external circumferential groove therein with at least the end thereof farthest from said one of said flange members being outwardly inclined, another end member adjacent to the end of said other of said header members facing in the direction away from said cylindrical member, means for clamping said another end member to said other of said header members comprising a sleeve member formed of a plurality of arcuately shaped parts located in said circumferential groove in said other of said header members and having at least the end thereof furthest from said one of said flange members beveled complementary to the taper of the adjoining end of said groove in said other of said header members, a split ring member surrounding said sleeve member and having its radial outer or circumferential surface inclined radially outwardly in the direction away from said end of said cylindrical member at which said one of said flange members is located, a retainer ring member surrounding said split ring member, a clamp plate at the end of said another of said end members at the end thereof facing in the direction away from the end of said cylindrical member at which said one of said flange members is located, and means for adjustably connecting said retainer ring member to said clamp plate.

2. A heat exchanger of the character described comprising an elongated shell having a tubular cylindrical member having flange members adjacent to its opposite ends, one of said flange members having a counterbore facing in the direction away from said cylindrical member, a plurality of tubes having their opposite ends connected to header members, means including an end member connecting one of said header members to the other of said flange members, the other of said header members having an outside diameter slightly less than the inside diameter of said end of said cylindrical member at which said one of said flange members is located and being slidable therein, said other of said header members having an external circumferential groove therein with at least the end thereof farthest from said one of said flange members being outwardly inclined, a seal at said end of said cylindrical member at which said one of said flange members is located including packing in said counterbore in said one of said flange members and a gland member slidable on said other of said header members, means for adjusting said gland member towards said one of said flange members, another end member adjacent to the end of said other of said header members facing in the direction away from said cylindrical member, means for clamping said another end member to said other of said header members comprising a sleeve member formed of a plurality of arcuately shaped parts located in said circumferential groove in said other of said header members and having at least the end thereof furthest from said one of said flange members beveled complementary to the taper of the adjoining end of said groove in said other of said header members, a split ring member surrounding said sleeve member and having its radial outer or circumferential surface inclined radially outwardly in the direction away from said end of said cylindrical member at which said one of said flange members is located, a retainer ring member surrounding said split ring member, a clamp plate at the end of said another of said end members at the end thereof facing in the direction away from the end of said cylindrical member at which said one of said flange members is located, and means for adjustably connecting said retainer ring member to said clamp plate.

3. A heat exchanger of the character described comprising an elongated shell having a tubular cylindrical member with flange members adjacent to its opposite ends, one of said flange members having a counterbore facing in the direction away from said cylindrical member, a plurality of tubes having their opposite ends connected to header members, means including an end member connecting one of said header members to the other of said flange members, the other of said header members having an outside diameter slightly less than the inside diameter of said end of said cylindrical member at which said one of said flange members is located and being slidable therein, said other of said header members having an external circumferential groove therein with at least the end thereof furthest from said one of said flange members being outwardly inclined, a seal at said end of said cylindrical member at which said one of said flange members is located including packing in said counterbore in said one of said flange members and a gland member slidable on said other of said header members a part of which gland member overlies one end of said external groove in said other of said header members, means for adjusting said gland member towards said one of said flange members, another end member adjacent to the end of said other of said header members facing in the direction away from said cylindrical member, means for clamping said another end member to said other of said header members comprising a sleeve member formed of a plurality of arcuately shaped parts located in said circumferential groove in said other of said header members with one end thereof underlying said gland member and having at least the other end thereof beveled complementary to the taper of the adjoining end of said grooves in said other of said header members, said sleeve member having an external groove spaced from said gland member in the direction away from said end of said cylindrical member at which said one of said flange members is located, a split ring member in said groove in said sleeve member extending radially of said sleeve member and having its radial outer or circumferential surface inclined radially outwardly in the direction away from said end of said cylindrical member at which said one of said flange members is located, a retainer ring member surrounding said split ring member, a clamp plate at the end of said another of said end members at the end thereof facing in the direction away from the end of said cylindrical member at which said one of said flange members is located, and means for adjustably connecting said retainer ring member to said clamp plate.

* * * * *